US006569023B1

(12) United States Patent
Briggs

(10) Patent No.: US 6,569,023 B1
(45) Date of Patent: May 27, 2003

(54) CHUTES AND LADDERS WATER RIDE

(75) Inventor: Rick A. Briggs, Springfield, IL (US)

(73) Assignee: Koala Corporation, Denver, CO (US)

( * ) Notice: Subject to any disclaimer, the term of this patent is extended or adjusted under 35 U.S.C. 154(b) by 0 days.

(21) Appl. No.: 09/550,469

(22) Filed: Apr. 17, 2000

Related U.S. Application Data

(60) Provisional application No. 60/129,594, filed on Apr. 16, 1999, and provisional application No. 60/162,692, filed on Nov. 1, 1999.

(51) Int. Cl.[7] ..... A63G 21/18

(52) U.S. Cl. ..... 472/117; 472/116; 472/128; 104/70

(58) Field of Search ..... 472/116, 117, 472/136, 137, 128; 482/35, 36; 104/69, 70, 53

(56) References Cited

U.S. PATENT DOCUMENTS

| | | | |
|---|---|---|---|
| 419,860 | A | 1/1890 | Libbey |
| 3,668,715 | A | 6/1972 | Chase |
| 3,743,281 | A | 7/1973 | Gimbel |
| 4,149,710 | A | 4/1979 | Rouchard |
| D253,363 | S | 11/1979 | Dieter et al. |
| 4,194,733 | A | 3/1980 | Whitehouse, Jr. |
| 4,196,900 | A | 4/1980 | Becker et al. |
| 4,198,043 | A | 4/1980 | Timbes et al. |
| 4,418,792 | A | 12/1983 | Cerone |
| 4,630,709 | A | 12/1986 | Taylor |
| 4,778,430 | A | 10/1988 | Goldfarb et al. |
| 4,805,897 | A | 2/1989 | Dubeta |
| 4,865,312 | A | 9/1989 | Katz |
| 4,973,042 | A | 11/1990 | Klopf et al. |
| 5,151,069 | A | 9/1992 | Skalka |
| 5,194,048 | A | 3/1993 | Briggs |
| 5,213,547 | A | 5/1993 | Lochtefeld |
| 5,226,864 | A | 7/1993 | Showers |
| 5,330,400 | A | 7/1994 | Huberman |
| 5,378,197 | A | 1/1995 | Briggs |
| D361,116 | S | 8/1995 | Shaneour |
| 5,505,663 | A | 4/1996 | Goulart et al. |
| 5,554,074 | A | 9/1996 | Von Parrish |
| 5,816,980 | A | 10/1998 | Myszka et al. |
| 5,820,471 | A | 10/1998 | Briggs |
| 5,865,680 | A | 2/1999 | Briggs |
| 5,884,563 | A | 3/1999 | Sheldon et al. |
| 6,186,902 | B1 * | 2/2001 | Briggs ..... 472/117 |

FOREIGN PATENT DOCUMENTS

| | | |
|---|---|---|
| DE | 38 12 435 C1 | 4/1988 |

OTHER PUBLICATIONS

SCS Interactive Family Adventures Brochure—"Caribbean Family Adventure".
Master Blaster Uphill Water Coaster Brochure.
Innovative Foam Technology, Inc. Brochure —"Tug Boat Slide" and "Cypress Shack Slide".
Braunfelsbilt Products Brochure (Dragon); WWA Waterpark Buyer's Guide (Jan. 1994).

* cited by examiner

*Primary Examiner*—Kien T. Nguyen
(74) *Attorney, Agent, or Firm*—Sheridan Ross P.C.

(57) ABSTRACT

A multi-level play structure is provided for entertaining play participants. The play structure comprises multiple play levels at various elevations, including an upper play level, a lower play level, and one or more intermediate play levels. Multiple gravity induced rides and climbing structures connect two or more of the play levels. At least one of the intermediate play levels is connected to two or more other play levels by at least one gravity induced ride and at least one climbing structure, thereby allowing play participants to choose between two or more different paths to other play levels upon reaching the intermediate play level.

20 Claims, 4 Drawing Sheets

CHUTES AND LADDERS WATER RIDE

CROSS-REFERENCE TO RELATED APPLICATIONS

The present application claims priority and benefit under 35 U.S.C. § 119(e) of U.S. Provisional Patent Application Ser. No. 60/129,594, entitled "Chutes and Ladders Water Ride," filed Apr. 16, 1999. The present application also claims priority and benefit under 35 U.S.C. § 119(e) of U.S. Provisional Patent Application Ser. No. 60/162,692, also entitled "Chutes and Ladders Water Ride," filed Nov. 1, 1999. Both of the aforementioned provisional patent applications are hereby incorporated by reference herein.

BACKGROUND OF THE INVENTION

1. Field of the Invention

The present invention relates to the field of play structures and, in particular, to the field of commercial play structures for entertaining multiple play participants.

2. Description of the Related Art

The popularity of family-oriented theme parks and commercial recreational facilities has increased dramatically. Water parks, in particular, have proliferated as adults and children alike seek the thrill and entertainment of water attractions as a healthy and enjoyable way to cool off in the hot summer months.

Water parks typically incorporate a variety of different water attractions. One of the most popular water attractions is the water slide. Commercial water slides typically include a riding surface and a plurality of water outlets at the upper entrance portion thereof for admitting water directly onto the riding surface. The water on the riding surface provides a lubricant, reducing friction between the ride participant and the riding surface. Additional water outlets may be interspersed at intervals along the length of the slide, as desired, to provide additional lubricant and/or to accelerate or decelerate the ride participant, as desired. The pull of gravity and/or water acceleration propels the ride participant from one end of the slide to the other. The ride participant typically exits the ride at the end by splashing into a receiving pool at ground level.

A climbing structure or stairway is typically provided adjacent the slide to enable ride participants to ascend to the entrance of the slide. Typically, only one person at a time is able to slide down the slide; others are either climbing the stairs to the top or waiting in an adjacent queuing area for their turn to ride down the water slide. Due to the popularity of these rides, the queuing areas often extend down the climbing structure, and participants may be forced to wait up to 20 minutes or more for their turn to slide down the riding surface. The extended waiting time is a common complaint among play participants since the ride itself typically lasts only a short while.

SUMMARY OF THE INVENTION

Accordingly, it is an object of the present invention to provide a more continuous and entertaining play experience for play participants. The play structure of the present invention comprises a number of different play levels interconnected by various climbing structures and rides. Upon reaching certain play levels, play participants are able to choose from two or more paths to other play levels. Unlike prior art play structures having one or more slides which start at the top of the structure and go all the way to the bottom, the play structure of the present invention allows play participants to explore a number of different paths through the play structure, enjoying a variety of rides along the way.

In accordance with one embodiment of the present invention, a multi-level play structure is provided for entertaining play participants. The play structure comprises multiple play levels at various elevations, including an upper play level, a lower play level, and one or more intermediate play levels. Multiple rides, such as gravity induced rides, and climbing structures connect two or more of the play levels. At least one of the intermediate play levels is connected to two or more other play levels by at least one ride and at least one climbing structure, thereby allowing play participants to choose between two or more different paths to other play levels upon reaching the intermediate play level.

In accordance with another embodiment of the present invention, a multi-level play structure is provided for entertaining play participants. The play structure comprises multiple play levels at various elevations, including an intermediate play level. A first ride connects the intermediate play level to a play level at a higher elevation, and a second ride connects the intermediate play level to a play level at a lower elevation. A climbing structure connects the intermediate play level to a play level at either a higher or lower elevation.

In accordance with another embodiment of the present invention, a multi-platform play structure for entertaining play participants is provided. They play structure comprises a plurality of platforms located at various elevations, including an intermediate platform. A climbing structure connects the intermediate platform to a higher platform, a first ride connects the intermediate platform to a higher platform, and a second ride connects the intermediate platform to a lower platform. Upon reaching the intermediate platform, play participants can choose either to climb the climbing structure to the higher platform or slide upon the second slide to the lower platform.

For purposes of summarizing the invention and the advantages achieved over the prior art, certain objects and advantages of the invention have been described herein above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment disclosed.

DETAILED DESCRIPTION OF THE PREFERRED EMBODIMENTS

Figure 1:
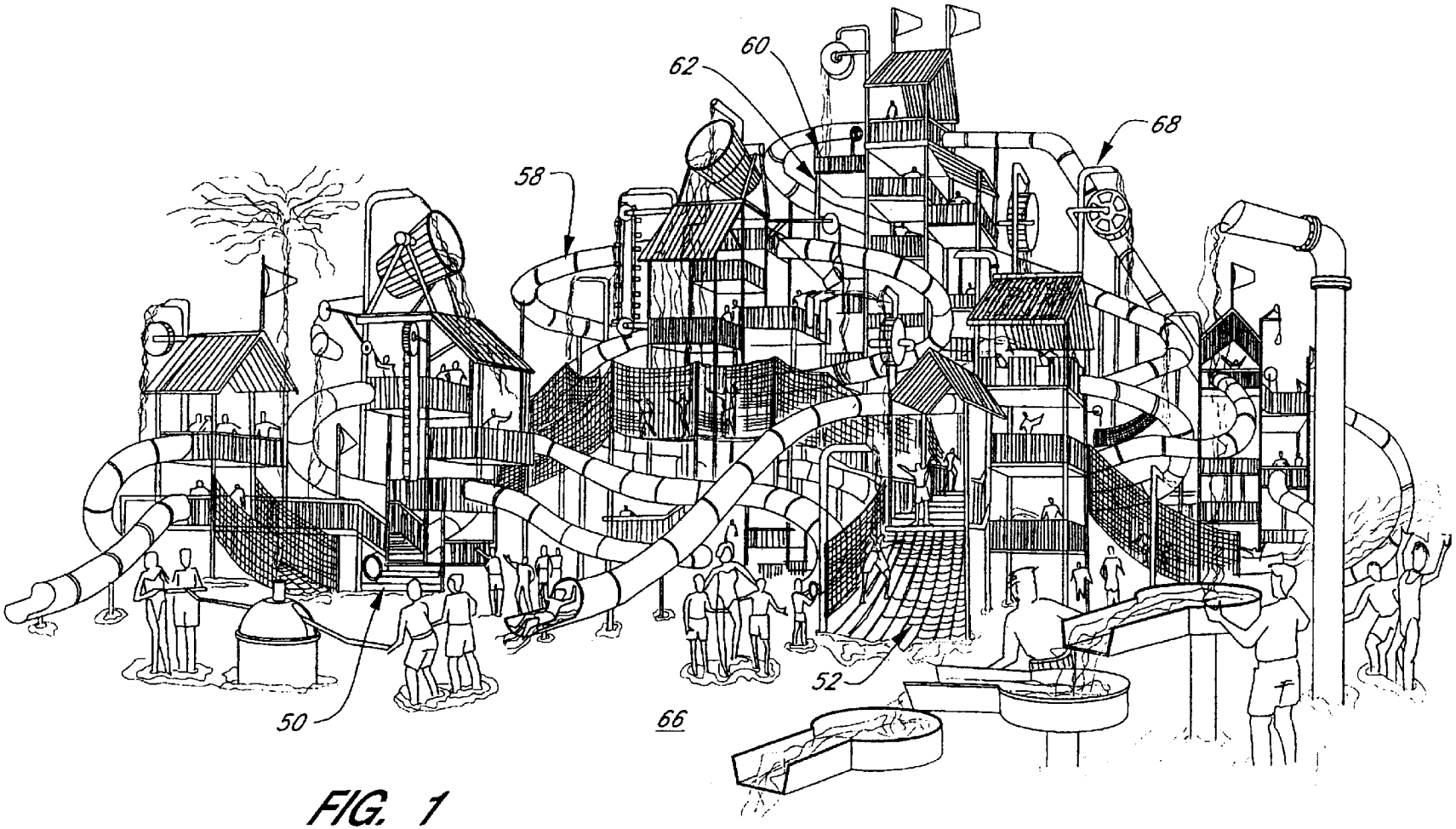
FIG. 1 is a perspective view of one possible embodiment of a play structure having features in accordance with the present invention.

FIG. 1 illustrates one possible embodiment of a play structure having features in accordance with the present invention. Fundamentally, the play structures comprises a number of play levels at various elevations interconnected by various climbing structures and rides. As used herein, the term "climbing structure" shall refer to any structure that allows play participants to climb or traverse from one play level to another play level at either a higher or lower elevation. Climbing structures may include, for example, stairways, climbing nets, ladders, ramps, bridges, crawl tunnels, ropes, climbing bars, and the like. In the illustrated embodiment, the climbing structures are principally stairways 50 and climbing nets 52. However, those of skill in the art will recognize that the play structure may include other types of climbing structures in addition to or instead of the stairways 50 and/or climbing nets 52.

Various rides also preferably interconnect the various play levels. As used herein, the term "ride" shall refer to any structure which transports play participants from one play level to another play level at either a higher or lower elevation. Rides may include both gravity induced rides, such as fire poles, swings, gravity induced water slides, dry slides, and the like, and other types of rides, such as elevators, conveyors, uphill water slides, and the like. In the illustrated embodiment, the rides are gravity induced water slides 58. However those of skill in the art will appreciate that the play structure may include other types of rides in addition to or instead of the water slides 58.

In the embodiment illustrated in FIG. 1, a number of the play levels are formed by platforms 60 which are supported above the ground by a supporting framework 62. However, the lowest play level in the illustrated embodiment comprises a large landing pool 66 formed at ground level. The platforms 60 and the supporting framework 62 are preferably constructed from materials having adequate strength, durability, and resistance to corrosion to safely support the play structure and play participants, such as pressure treated wood, galvanized steel, or aluminum. The supporting framework 62 may also include one or more water supply pipes 68 for carrying water under pressure to various locations around the play structure.

Figure 2:
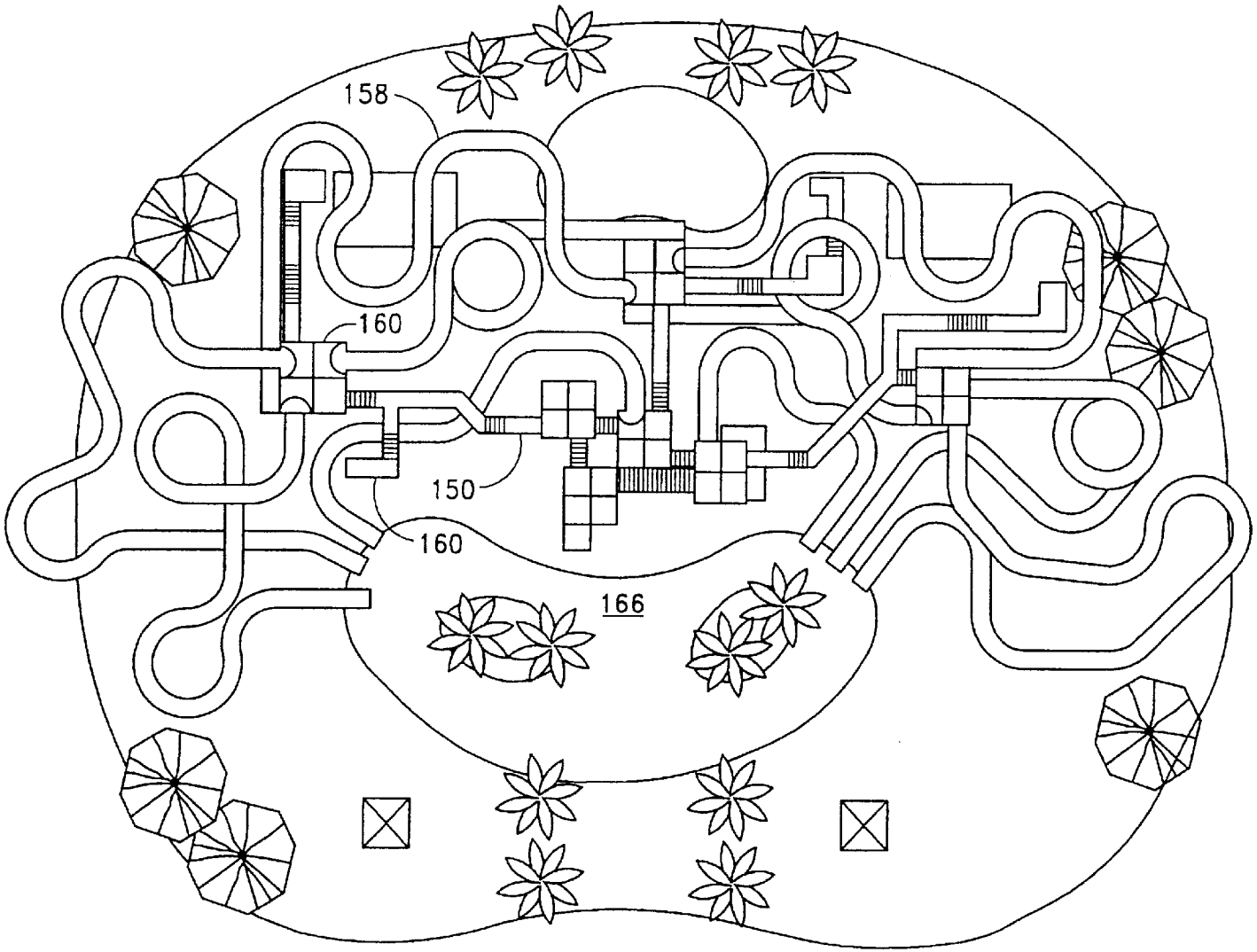
FIG. 2 is a plan view of another embodiment of a play structure having features in accordance with the present invention.

FIG. 2 is a top plan view of another possible embodiment of a play structure having features in accordance with the present invention. As in the embodiment of FIG. 1, the play structure includes a number of different play levels interconnected by various climbing structures and rides. In this embodiment, the climbing structures are stairways 150 and the rides are gravity induced water slides 158. However, as indicated above, it is to be understood that the play structure may include other types of climbing structures and/or rides in addition to or instead of the stairways 150 and water slides 158.

As in the previous embodiment, a number of play levels are formed by platforms 160 which are supported at various elevations. The layout of the play structure is preferably such that the water slides 158 bend around and between the various platforms 160 and stairways 150, as illustrated in FIG. 2. This allows the play participants on the platforms 160 and stairways 150 to see and interact with the play participants sliding on the water slides 158.

The water slides 158 preferably have a variety of different configurations. Some of the slides 158 may be spiral in shape while others are relatively straight; some may have steep slopes while others are more gradual; some may be enclosed tunnels and others open; some may require inner tubes and some may not. In addition, the play structure may include various specialty slides, such as pinball-type slides, or uphill water slides of the type described in U.S. Pat. No. 5,213,547, hereby incorporated by reference herein. The greater the variety of water slides 158, the more entertaining the play structure.

Some of the water slides 158 in the embodiment shown in FIG. 2 terminate at a landing pool 166 formed at the lowest play level. However, other water slides 158 terminate at intermediate play levels at higher elevations. In the illustrated embodiment, at least one of the intermediate play levels is connected to two or more other play levels by at least one slide and at least one climbing structure, thereby allowing play participants to choose between two or more different paths to other play levels.

Figure 3:
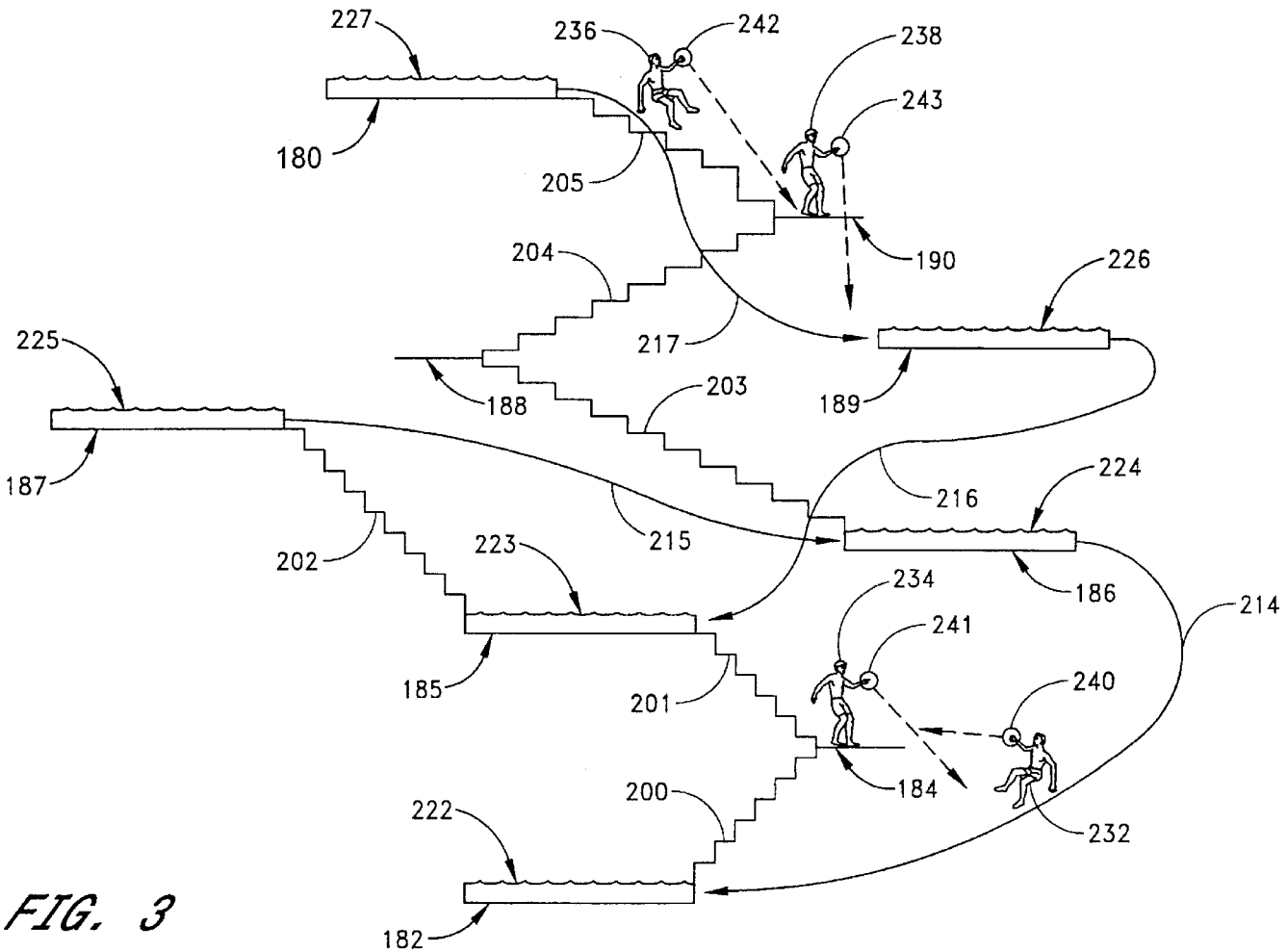
FIG. 3 is a simplified schematic illustration of another embodiment of a play structure having features in accordance with the present invention.

FIG. 3 is a simplified schematic illustration of another embodiment of a play structure having features of the present invention. As illustrated in FIG. 3, the play structure includes an upper play level 180, a lower play level 182, and a number of intermediate play levels 184, 185, 186, 187, 188, 189, and 190. The play levels are interconnected by a number of climbing structures and gravity induced rides. For purposes of illustration, the climbing structures are shown at stairways 200, 201, 202, 203, 204, 205, and the gravity induced rides are shown as water slides 214, 215, 216, 217, 218. The play levels that constitute entrance and/or exit points of one or more of the water slides 214, 215, 216, 217 are shown as having entrance and/or exit pools 222, 223, 224, 225, 226, 227.

Play participants ascend the play structure by climbing the stairways 200, 201, 202, 203, 204, 205 to reach the upper play level 180 or one of the intermediate play levels 184, 185, 186, 187, 188, 189, 190. Three of the intermediate play levels in the illustrated embodiment, play levels 185, 186, and 187, are connected to two or more other play levels each by at least one water slide and at least one stairway. Upon reaching one of these play levels 185, 186, 187, play participants are able to choose between two or more paths to other play levels. For example, from intermediate play level 185, play participants can choose either to climb stairway 202 to intermediate play level 187 or descend stairway 201 to play level 184. From intermediate play level 186, play participants can choose either to climb stairway 203 to intermediate play level 188 or slide down water slide 214 to the lower play level 182. From intermediate play level 187, play participants can choose either to descend stairway 202 to intermediate play level 185 or slide down water slide 215 to intermediate play level 186.

By allowing play participants to choose from a number of different paths through the play structure, the play experience is made more entertaining and exciting. Of course, the particular arrangement of the play levels, climbing structures, and rides illustrated in FIG. 3 is only one of many possible arrangements. Those of skill in the art will recognize that the play structure may include a greater or lesser number of play levels arranged in any number of different ways, and that a variety of different types of climbing structures and rides, such as gravity induced slides or powered uphill slides, may be used to interconnect the various play levels.

In a particularly preferred embodiment of the present invention, the play structure has a sufficient number and variety of play levels, climbing structures, and rides to present a bewildering array of choices to play participants. The size and arrangement of the play structure may be such that it is challenging for play participants to determine exactly how to get from one particular play level to another. Play participants are thus entertained by trying to figure out what combination of climbing structures and rides must be traversed to reach a particular play level.

Unlike some prior art play structures having one or more slides which start at the top of the structure and go all the way to the bottom, the play structure of the present invention allows play participants to explore a number of different paths and play levels. Instead of waiting in a long queue line to reach the top of the play structure for a short ride to the bottom again, the play structure of the present invention affords play participants a more continuous and entertaining play experience with less waiting.

For added entertainment and excitement, the play structure of the present invention may also include various interactive play elements for creating desired play effects. As described in my co-pending U.S. patent application Ser. No. 08,914,672, filed Aug. 19, 1997 and hereby incorporated by reference herein, such play elements may include both those which may be activated by play participants on the gravity induced rides, and those which may be activated by play participants on the adjacent climbing structures and nearby or remote play levels. By activating the play elements, play participants can trigger various desired water or other play media effects, allowing interaction with the play structure and/or other play participants.

For example, in the embodiment of FIG. 3, a number of different play elements may be provided for allowing interaction between the play participants on the play levels 180, 182, 184, 186, 188, 190 and the play participants on the water slides 214, 215, 216, 217. The play elements may be activated by sensor/actuator devices located at various points in and around the play structure. For example, a play participant 232 sliding on slide 214 can activate a sensor/actuator 240 and thereby cause water to issue toward a play participant 234 standing at play level 184. In return, the play participant 234 standing at play level 184 can activate a sensor/actuator 241 to cause water to issue toward the play participants 232 sliding on slide 214. In a similar manner, a play participant 236 sliding on water slide 217 can activate a sensor/actuator 242 to cause water to issue toward a play participant 238 standing at play level 190. The play participant 238 standing at play level 190 can return fire by activating a sensor/actuator 243 to cause water to issue toward the play participant 236 sliding on water slide 217. By allowing the play participant standing at the play levels to interact with the play participants on the water slides, a more exciting and enjoyable play experience is had by all.

In alternative embodiments, the play structure may be configured so that play participants can participate in individual or team scoring. Whenever a play participant completes a certain task, the play participant or team of play participants may be awarded points for successful completion of the task. For example, points may be awarded to play participants for traversing a certain sequence of rides and climbing structures, hitting certain targets, or creating certain play effects. Points and scoring may be tracked using tags and/or sensors as described in my U.S. patent application Ser. No. 08/914,672, or by other means as will be readily apparent to persons skilled in the art, such as RF bracelets, electronic or magnetic cards, tracking numbers, PIN codes or the like. Once a play participant or team of play participants has accumulated sufficient points, as read by turnstiles at strategic locations in the play structure, the play participant or team may be granted access to certain rides or areas of the play structure which are off limits to other play participants.

Figure 4:
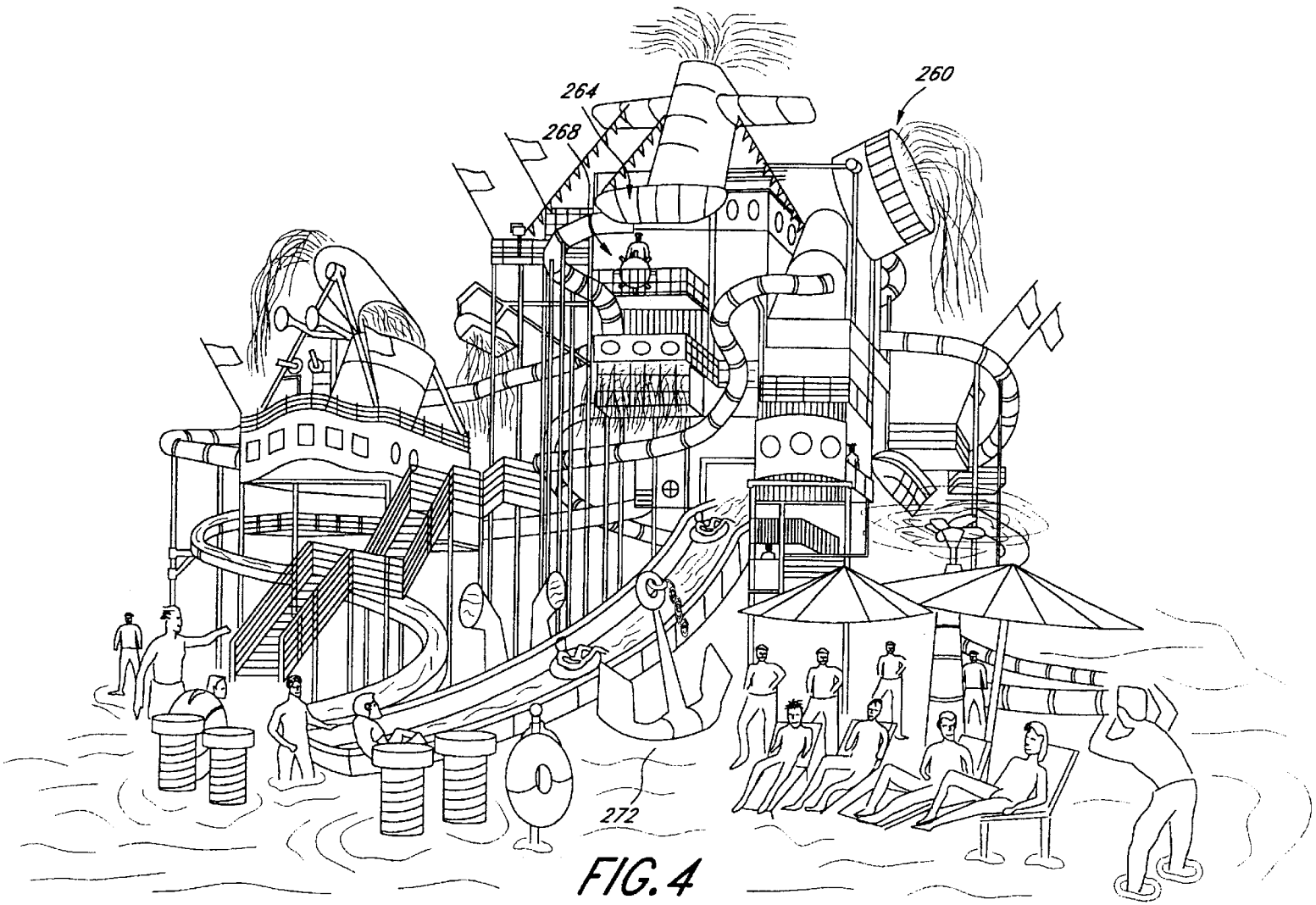
FIG. 4 is a perspective view of another embodiment of a play structure having features in accordance with the present invention.

For visual appeal and added safety, decorative panels and/or roofing elements may be provided on the play structure. Various play themes may also be created, as desired. FIG. 4 illustrates another preferred embodiment of a play structure having features in accordance with the present invention. In the embodiment shown in FIG. 4, the play structure is made to resemble a cruise ship with stacks 260, lifeboats 264, a bridge 268, and an anchor 272. In a preferred embodiment of the cruise ship play structure of FIG. 4, the tops of the stacks 260 fill with water and tip periodically to spill large quantities of water on the play participants below.

Those skilled in the art will appreciate that a variety of other play themes are possible. For example, the play structure may be constructed to resemble a mining tower, a pirate's ship, a submarine, a medieval castle, a lost temple, or a fire station. An endless variety of different decorative or thematic elements may be incorporated into the overall design of the play structure in order to convey a particular play theme or provide added safety.

The invention has been disclosed and described in the context of various preferred embodiments. It will be understood by those skilled in the art that the present invention extends beyond the specific disclosed embodiments to other possible alternative embodiments. Thus, it is intended that the scope of the present invention herein disclosed should not be limited by the disclosure and drawings contained herein, except as encompassed by a fair reading of the claims that follow.

What is claimed is:

1. A multi-level play structure for entertaining play participants, comprising:

plurality of multiple play level sets, each multiple play level set including an upper play level, a lower play level, and one or more intermediate play levels, said upper level, lower level and one or more intermediate levels having various elevations;

multiple rides connecting two or more of said play levels;

multiple rides connecting two or more of said play level sets;

multiple climbing structures connecting two or more of said play levels; and multiple climbing structures connecting two or more of said play level sets;

wherein at least one of said intermediate play levels is connected to two or more other play levels by at least one ride and at least one climbing structure, thereby allowing play participants to choose between two or more different paths to other play levels upon reaching said intermediate play level.

2. The multi-level play structure of claim 1, wherein at least one of said rides is a gravity induced ride.

3. The multi-level play structure of claim 2, wherein said gravity induced ride is a water slide, dry slide, fire pole, swing, or any combination of these.

4. The multi-level play structure of claim 2, wherein said play structure includes one or more play element which can be activated by play participants while riding said gravity induced rides to create desired play effects.

5. The play structure of claim 4, wherein the play elements are a waterfall, a trough dump, a geyser jet, a bucket dump, a rope and pulley, a wheel, a mist sprayer, a fog sprayer, a splash pool, or any combination of these.

6. The multi-level play structure in claim 1, wherein at least one of said rides is an elevator, conveyor, uphill water slide, or any combination of these.

7. The multi-level play structure of claim 1, wherein at least one of said climbing structures is a stairway, climbing net, ladder, ramp, bridge, crawl tunnel, rope, climbing bars, or any combination of these.

8. The multi-level play structure of claim 1, wherein said play structure includes one or more play elements which can be activated by play participants on said climbing structures or play levels to create desired play effects.

9. The play structure of claim 8, wherein the play elements are a waterfall, a trough dump, a geyser jet, a bucket dump, a rope and pulley, a wheel, a mist sprayer, a fog sprayer, a splash pool, or any combination of these.

10. The multi-level play structure of claim 1, wherein said play structure is made to resemble a cruise ship.

11. The multi-level play structure of claim 1, wherein said play structure is made to resemble a mining tower.

12. A multi-level play structure for entertaining play participants, comprising:

a plurality of multiple play level sets, each play level set including at least one intermediate play level;

a first ride connecting said intermediate play level to a play level at a higher elevation or at another play level set;

a second ride connecting said intermediate play level to a play level at a lower elevation or at another play level set;

a third ride connecting said intermediate play level to a play level at another play level set either at a higher, lower, or equal elevation;

a climbing structure connecting said intermediate play level to a play level at either a higher or lower elevation; and, a climbing structure connecting said intermediate play level to another play level set at either a higher, lower, or equal elevation.

13. The multi-level play structure of claim 12, wherein at least one of said first and second rides is a gravity induced ride.

14. The multi-level play structure of claim 13, wherein said gravity induced ride is a water slide, dry slide, fire pole, swing, or any combination of these.

15. The multi-level play structure of claim 12, wherein at least one of said rides is an elevator, conveyor, uphill water slide, or any combination of these.

16. The multi-level play structure of claim 12, wherein at least one of said climbing structures is a stairway, climbing net, ladder, ramp, bridge, crawl tunnel, rope, climbing bars, or any combination of these.

17. The multi-level play structure of claim 12, wherein said play structure includes one or more play elements which can be activated by play participants while riding said gravity induced rides to create desired play effects.

18. The multi-level play structure of claim 12, wherein said play structure includes one or more play elements which can be activated by play participants on said climbing structures or play levels to create desired play effects.

19. The play structure of claim 18, wherein the play elements are a waterfall, a trough dump, a geyser jet, a bucket dump, a rope and pulley, a wheel, a mist sprayer, a fog sprayer, a splash pool, or any combination of these.

20. A multi-level play structure for entertaining play participants, comprising:

a plurality of sets, each set comprising a plurality of platforms located at various elevations and including an intermediate platform;

a climbing structure connecting said intermediate platform to a higher platform;

a first ride connecting said intermediate platform to a higher platform; and a second ride connecting said intermediate platform to a lower platform;

whereupon reaching said intermediate platform, play participants can choose either to climb said climbing structure to said higher platform or ride said second slide to said lower platform; and wherein said first and second rides are water slides.

* * * * *